US012692783B1

(12) United States Patent
Stair et al.

(10) Patent No.: US 12,692,783 B1
(45) **Date of Patent: *Jul. 28, 2026**

(54) SHOE TRACK ASSEMBLY SYSTEM AND METHOD OF USE

(71) Applicant: Citadel Casing Solutions, LLC, Houston, TX (US)

(72) Inventors: Todd Stair, Conroe, TX (US); Henry E. Rogers, Owasso, OK (US); Jimmy Venizelos, Richmond, TX (US); Carlos A. Valdez, Humble, TX (US)

(73) Assignee: Citadel Casing Solutions LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/821,917

(22) Filed: Aug. 30, 2024

Related U.S. Application Data

(63) Continuation of application No. 17/959,719, filed on Oct. 4, 2022, now Pat. No. 12,091,966, which is a continuation of application No. 16/442,802, filed on Jun. 17, 2019, now Pat. No. 11,459,874.

(60) Provisional application No. 62/827,642, filed on Apr. 1, 2019.

(51) Int. Cl.

| | |
|---|---|
| ***E21B 47/117*** | (2012.01) |
| ***E21B 33/12*** | (2006.01) |
| ***E21B 33/16*** | (2006.01) |
| ***E21B 34/06*** | (2006.01) |

(52) U.S. Cl.
CPC ..... *E21B 47/117* (2020.05); *E21B 33/12* (2013.01); *E21B 33/16* (2013.01); *E21B 34/06* (2013.01)

(58) Field of Classification Search
CPC ..... E21B 17/043; E21B 47/117; E21B 33/12; E21B 33/16; E21B 34/06; E21B 17/06; E21B 21/10; E21B 33/146
See application file for complete search history.

(56) References Cited

U.S. PATENT DOCUMENTS

| | | | | |
|---|---|---|---|---|
| 5,732,775 | A | 3/1998 | Hudson et al. | |
| 9,297,230 | B2 | 3/2016 | Stair | |
| 10,487,618 | B2 | 11/2019 | Budde et al. | |
| 11,459,874 | B1 * | 10/2022 | Stair | E21B 17/14 |
| 12,091,966 | B1 * | 9/2024 | Stair | E21B 34/10 |
| 2015/0101801 | A1 | 4/2015 | Budde et al. | |

(Continued)

FOREIGN PATENT DOCUMENTS

| | | | | |
|---|---|---|---|---|
| WO | WO-2019078808 A1 * | 4/2019 | | E21B 21/10 |

OTHER PUBLICATIONS

Latch Down Float Collar. 2015.

(Continued)

*Primary Examiner* — Daniel P Stephenson
(74) *Attorney, Agent, or Firm* — AVEK IP, LLC

(57) ABSTRACT

A method of well construction includes first, providing a tool with a housing extending from a top end to a bottom end; then, positioning a first valve within the housing, the first valve creating a seal within the housing to prevent fluid flow past the first valve and into a well casing from the bottom end of the housing during a well operation; next, securing the tool to the well casing; then, running the tool and the well casing into a wellbore; and, finally, performing one or more well operations, the one or more well operations do not establish cement integrity within the tool such that the first valve is not filled with cement.

15 Claims, 7 Drawing Sheets

(56) References Cited

U.S. PATENT DOCUMENTS

| | | | |
|---|---|---|---|
| 2016/0006161 | A1 | 1/2016 | Ranalli et al. |
| 2018/0112487 | A1 | 4/2018 | Budde et al. |
| 2018/0112488 | A1 | 4/2018 | Budde et al. |
| 2020/0095840 | A1 | 3/2020 | Gill et al. |

OTHER PUBLICATIONS

Hank Rogers, Dave Allison, and Earl Webb, Halliburton. New Equipment Designs Enable Swellable Technology in Cementless Completions. IADC/SPE 112302. 2008.
Lovelady. Antelope Tool Technical Data Sheet. Sep. 3, 2015.
Ryan Hord, Quicksilver Resourses; Thad Scott, SPE, Fred Weeks, SPE, and Marcel Budde, Weatherford International Ltd. A Cost-Effective Alternative Method of Deploying Perforating Devices in High-Angle Wells. SPE/IADC 140304. 2011.

* cited by examiner

SHOE TRACK ASSEMBLY SYSTEM AND METHOD OF USE

RELATED APPLICATIONS

This application is a continuation of U.S. application Ser. No. 17/959,719, filed Oct. 4, 2022, which is a continuation of U.S. application Ser. No. 16/442,802, filed Jun. 17, 2019, which issued as U.S. Pat. No. 11,459,874, which further claims priority from U.S. Provisional Application No. 62/827,642, filed Apr. 1, 2019, all of the foregoing incorporated by reference in their entireties.

FIELD OF THE DISCLOSURE

The present invention relates generally to wellbore shoe track systems, and more specifically, to a shoe track assembly system for increasing efficiency and eliminating a plurality of components of conventional systems, thereby reducing the cost associated with the wellbore system as a whole as well as increase the productivity.

DESCRIPTION OF RELATED ART

Well drilling systems are well known in the art and are effective means to collect resources for energy use. For example, FIG. 1 depicts a flowchart of a conventional well drilling operation. Conventional operations utilize a shoe track that is spaced in intervals of casing joints, and extending from a float shoe at the bottom to a top plug/landing collar at the top, and having a plurality of casing threads between the components, as shown with boxes 103, 105. Cementing operations are performed to create cement integrity around the casing shoe, which provides structural strength necessary to support continued drilling, as shown with box 107. As is known in the art, pressure testing is completed to ensure strength of the casing string, as shown with box 109. After such pressure testing, continued well operations can be performed as is known in the art and desired by the user, as shown with box 111.

One of the problems commonly associated with conventional systems and methods is cost and efficiency. For example, the conventional shoe track utilizes a plurality of casing joints and can extend to 160 feet in length. Each casing joint increases the cost of operation and decreases the efficiency of operation. Accordingly, it is desirable to provide a system that can reduce the number of casing threads and reduce the overall length associated with the shoe track, thereby gaining efficiency associated with the wellbore operation.

The system of the present invention utilizes a system that includes a single tool that can be approximately 5 feet long, thereby drastically reducing the number of components needed for the well drilling operation, which reduces the cost and improves efficiency.

BRIEF DESCRIPTION OF THE SEVERAL VIEWS OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
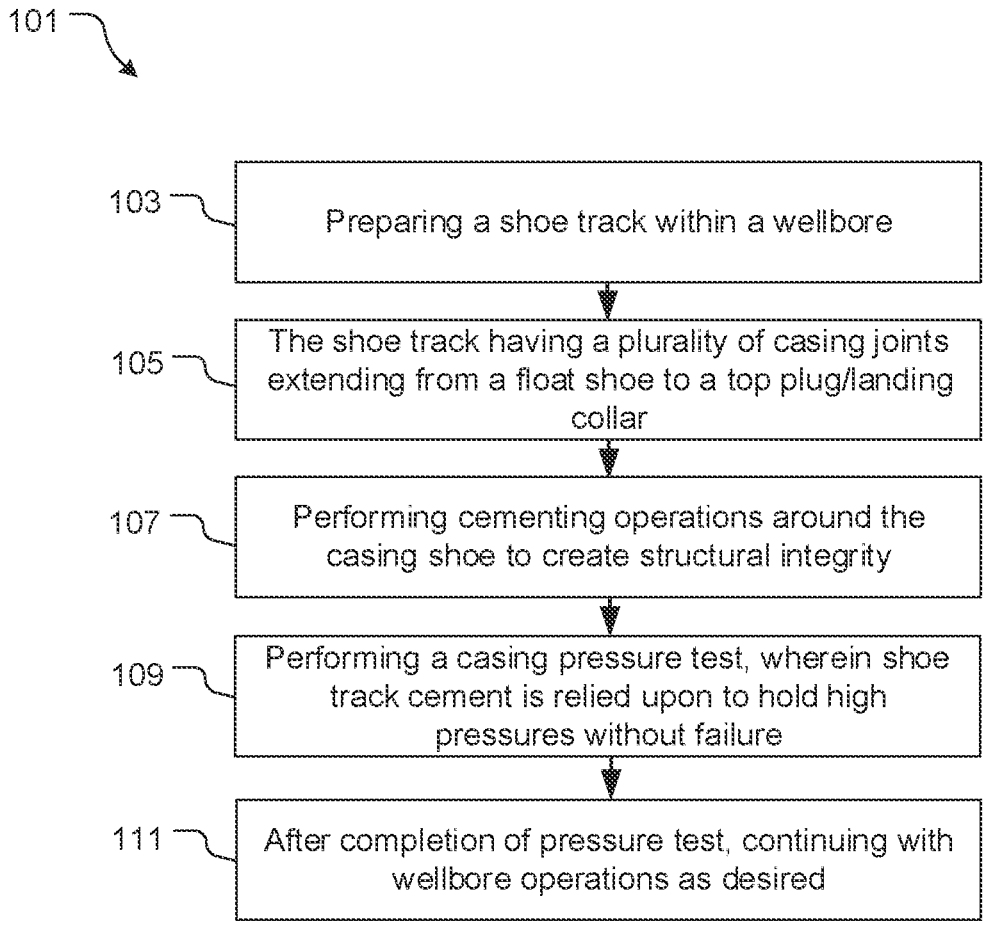
FIG. 1 (Prior Art)
FIG. 1 is a flowchart of a common well drilling operation.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wellbore operations. Specifically, the present invention provides for a wellbore integrity and barrier system with a single tool that is approximately 5 feet in length that can be utilized for pressure testing operations and eliminates the need for a plurality of casing sections joined by casing joints, as is known in the art. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
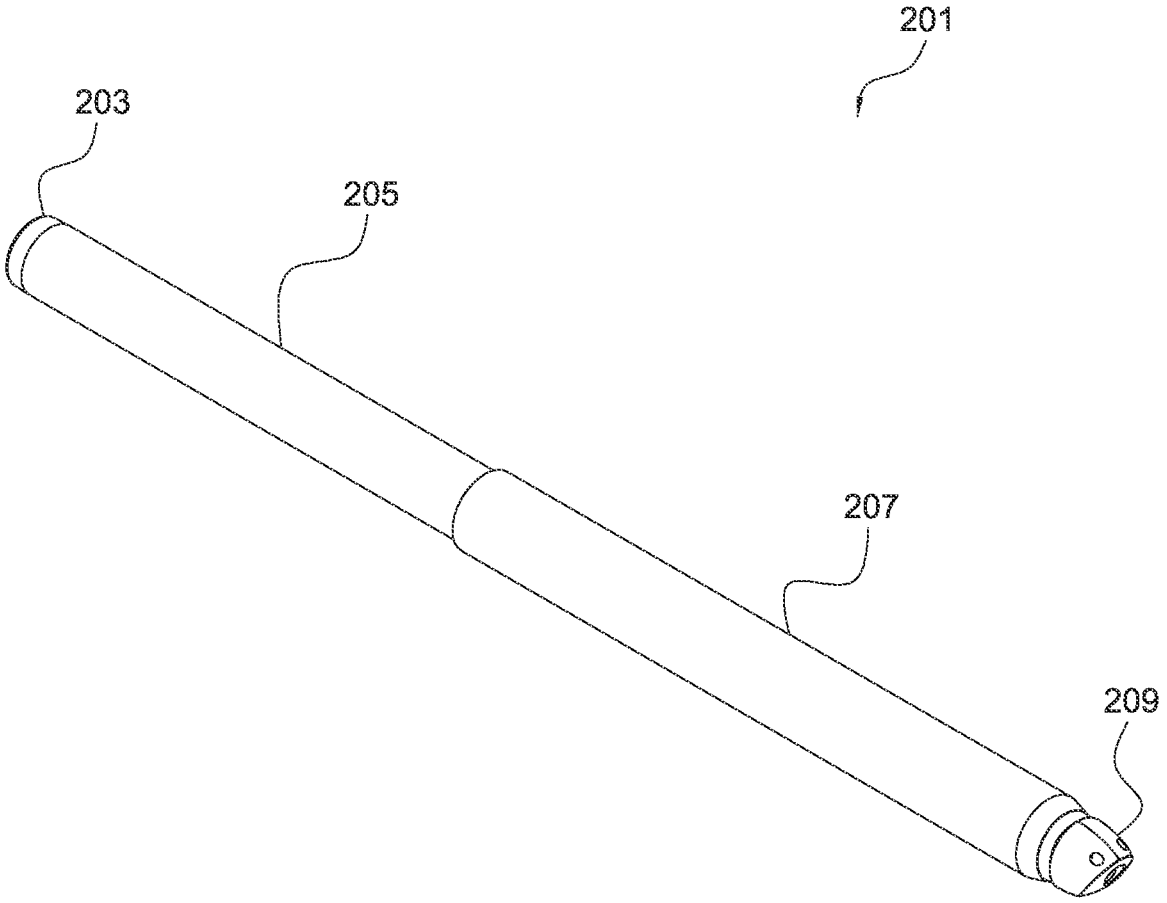
FIG. 2 is an isometric view of a shoe track tool in accordance with a preferred embodiment of the present application.
Figure 3:
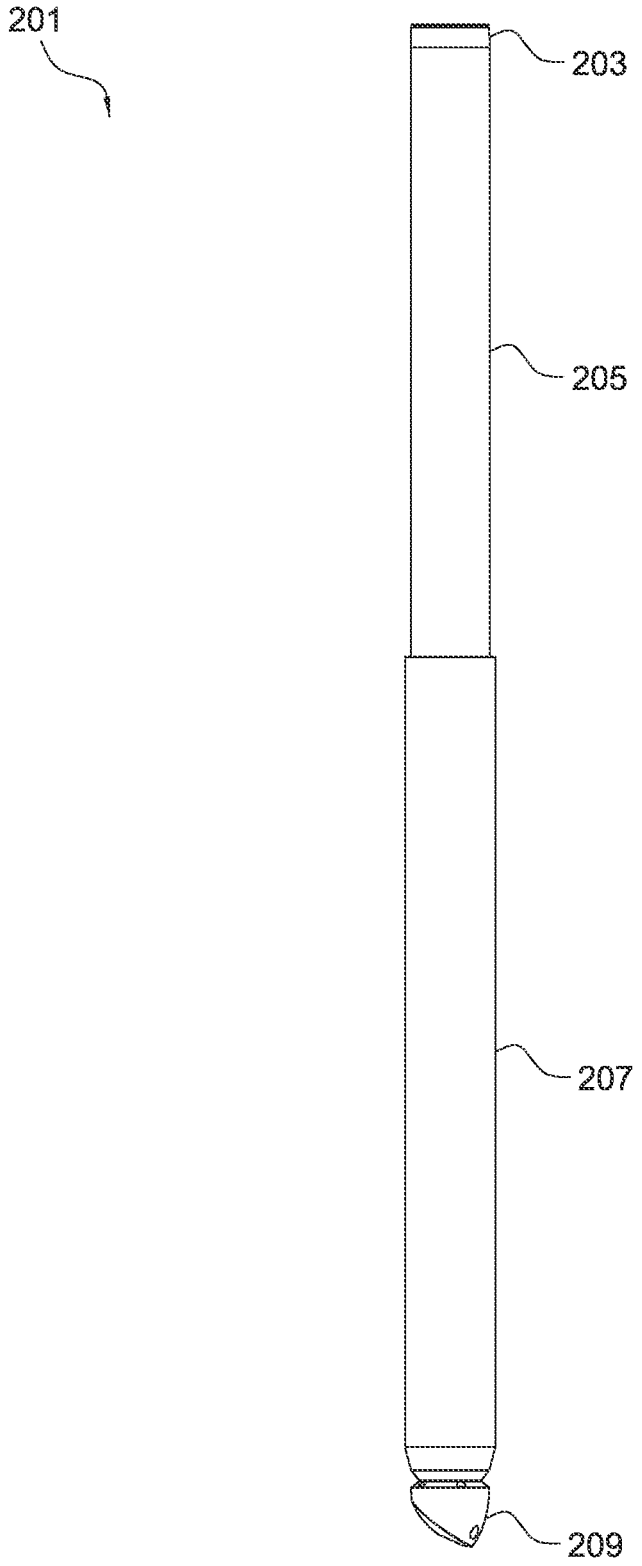
FIG. 3 is a front view of the tool of FIG. 2.

Referring now to the drawings wherein like reference characters identify corresponding or similar elements throughout the several views, FIGS. 2 and 3 depict isometric and front views of tool 201 in accordance with a preferred embodiment of the present application. It will be appreciated that tool 201 provides a means to improve efficiency associated with wellbore operations.

In the contemplated embodiment, tool 201 includes a housing 207 secured to a casing 203, 205 at a single connection, wherein the housing 207 extends from the casing to a guide nose 209. It should be appreciated that the guide nose can vary as desired by the operator. In the preferred embodiment, the housing is approximately five (5) feet in length, however, it should be appreciated that moderate variations from this length could be used and provide the same benefits as the tool described herein.

Figure 4:
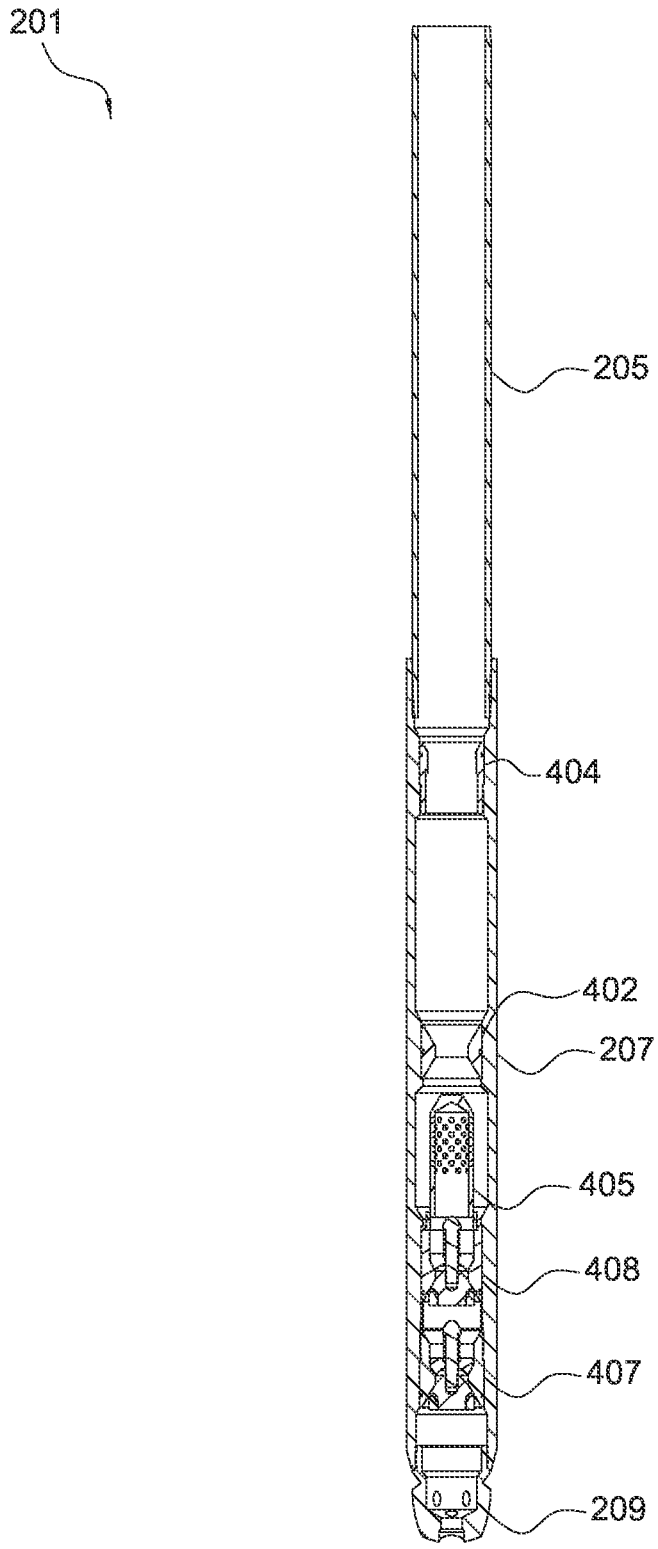
FIG. 4 is a front cross-sectional view of the tool of FIG. 2.

In FIG. 4, a cross-sectional view further depicts the interior components of tool 201. Tool 201 including a first valve 407 and a second valve 408, the first and second valves positioned above the guide nose and providing a seal within the elongated body and configured to withstand extreme pressure. It should be appreciated that additional valves could be used within the housing. In one particular embodiment, the first and second valves are 15 ksi gas-tight float valves, however, it is contemplated and should be appreciated that alternative embodiments could include alternative valves known or developed in the future that provide sealing capabilities within the elongated body.

As further shown, tool 201 further includes a bottom plug landing seat 402, being at a position above the valves 407,408 and extending into the interior area of the housing. The bottom plug landing seat 402 is configured to receive and engage with a bottom plug 403, as is known in the art.

Tool 201 further includes a top plug landing seat 401 that is positioned above the bottom plug landing seat and extends into the interior area of the housing and is configured to engage with a top plug 404. The engagement of the top and bottom plugs with the corresponding landing seats is shown in FIG. 5.

It should be appreciated that one of the unique features believed characteristic of the present application is that the top plug is configured to land within the elongated body of the tool. This feature, along with the remaining configuration of the tool, provides a means for greatly reducing the length of the shoe track. This reduced length and inclusion of all components into one tool provides the well operator with forty or more feet of additional pay zone exposure. In addition, this eliminates up to six casing threads, as well as float collars, and landing collars, again greatly increasing the efficiency and reducing the cost associated with conventional systems.

Another unique feature of the present invention is that tool 201 does not require the cement integrity of the conventional methods, to withstand casing pressure tests. It should be appreciated that conventional cementing plugs cannot handle the high pressure of the casing pressure test, or hydraulic opening pressures of associated upstream tools such as toe initiator valves. However, the equipment of tool 201, provide a means to withstand the pressure during testing. Valves 407, 408 prevent formation fluids from entering the wellbore from below, and the top plug 404, which can be a 15 ksi latch down plug, allows for casing pressure tests and toe valve opening, without relying on shoe track cement integrity.

Figure 5:
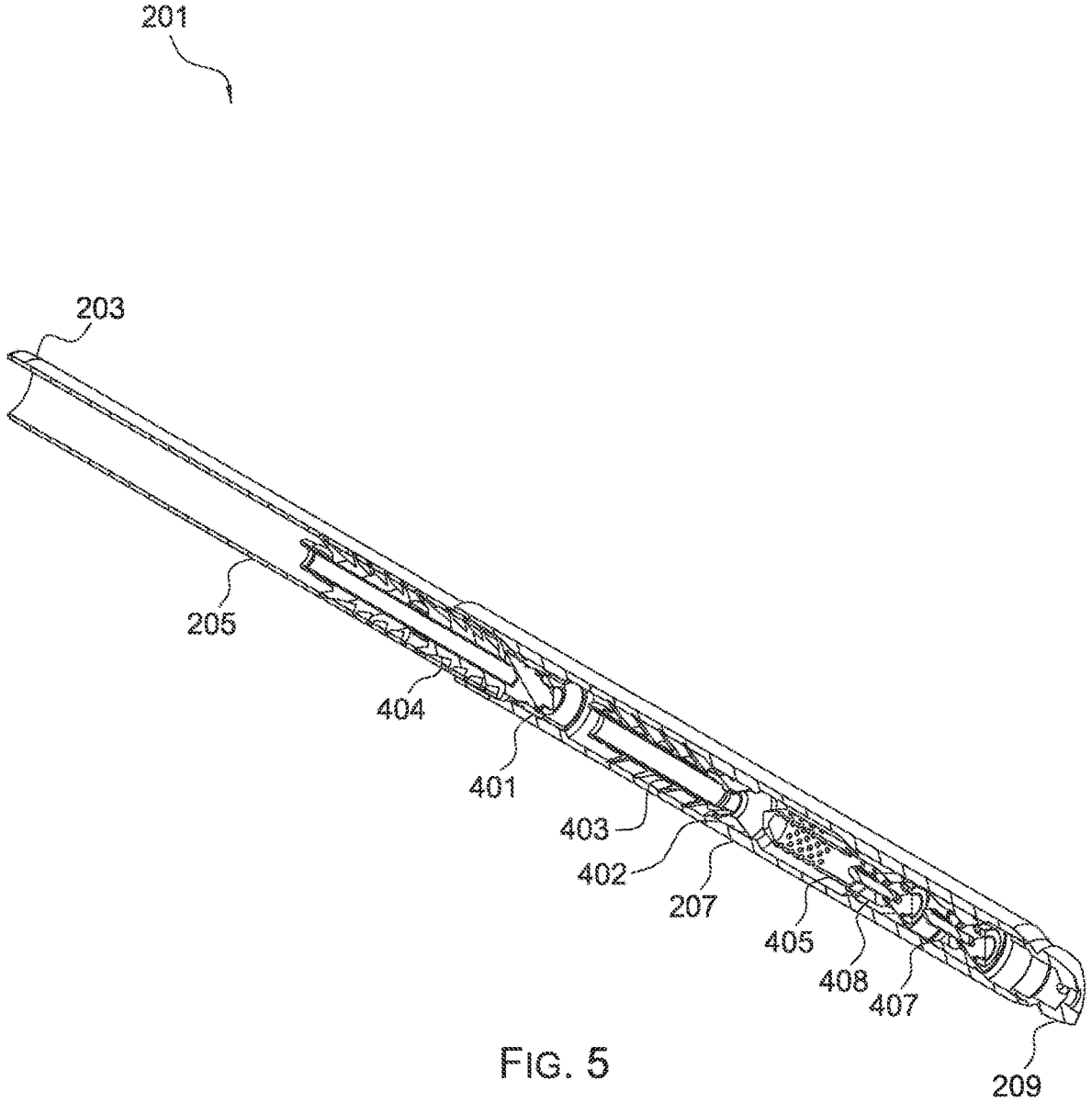
FIG. 5 is an isometric cross-sectional view of a shoe track assembly system with the tool of FIG. 2, a bottom plug, and a top plug in accordance with a preferred embodiment of the present application.

As also shown in FIGS. 4 and 5, the tool can further include a debris catcher system 405. This system can vary among debris catchers that are known in the art and provide a means to collect and store debris within the tool to help avoid and mitigate any damage from unwanted debris.

Figure 6:
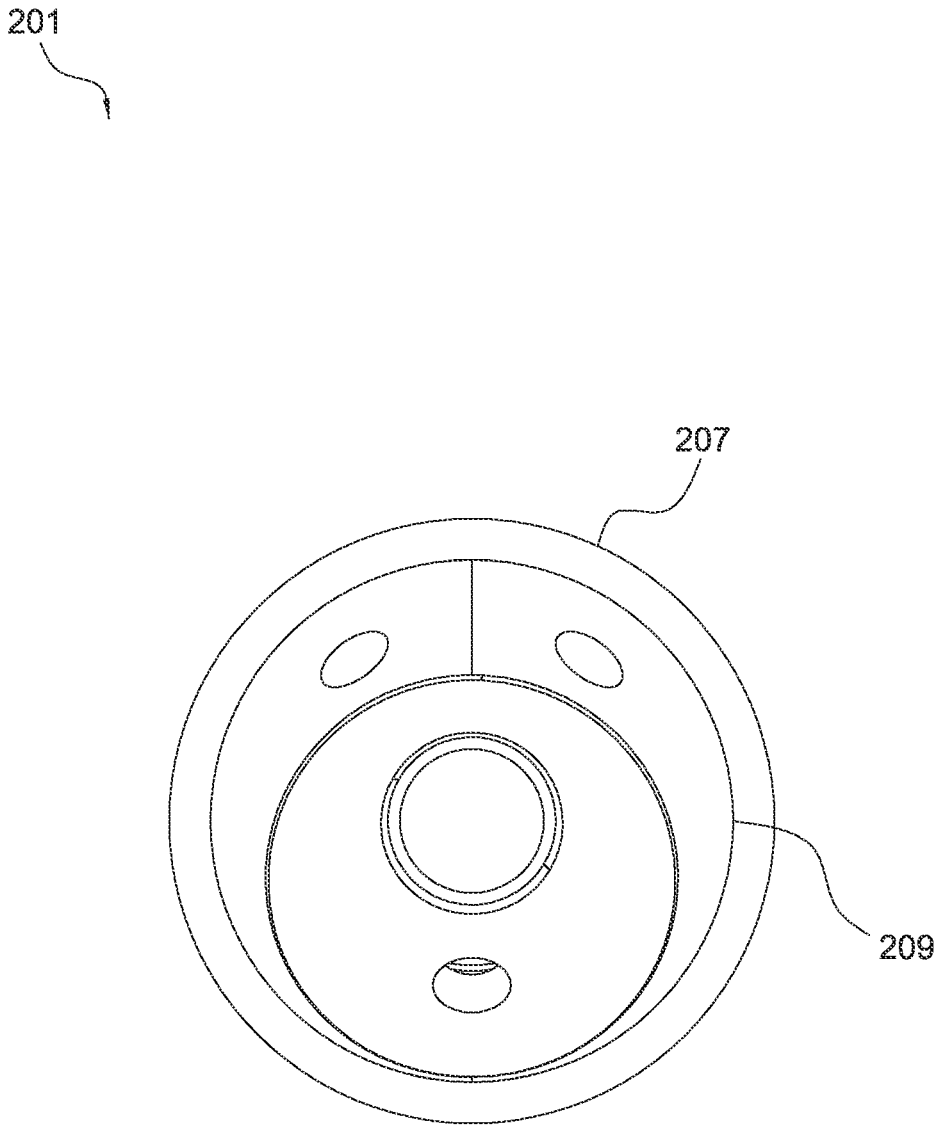
FIG. 6 is an end view of the tool of FIG. 2.

In FIG. 6, an end view of the tool 201 is shown for clarity, wherein guiding nose 209 is shown having a plurality of ports. Again, it should be appreciated and understood that the system could be altered with various guiding noses as desired.

Figure 7:
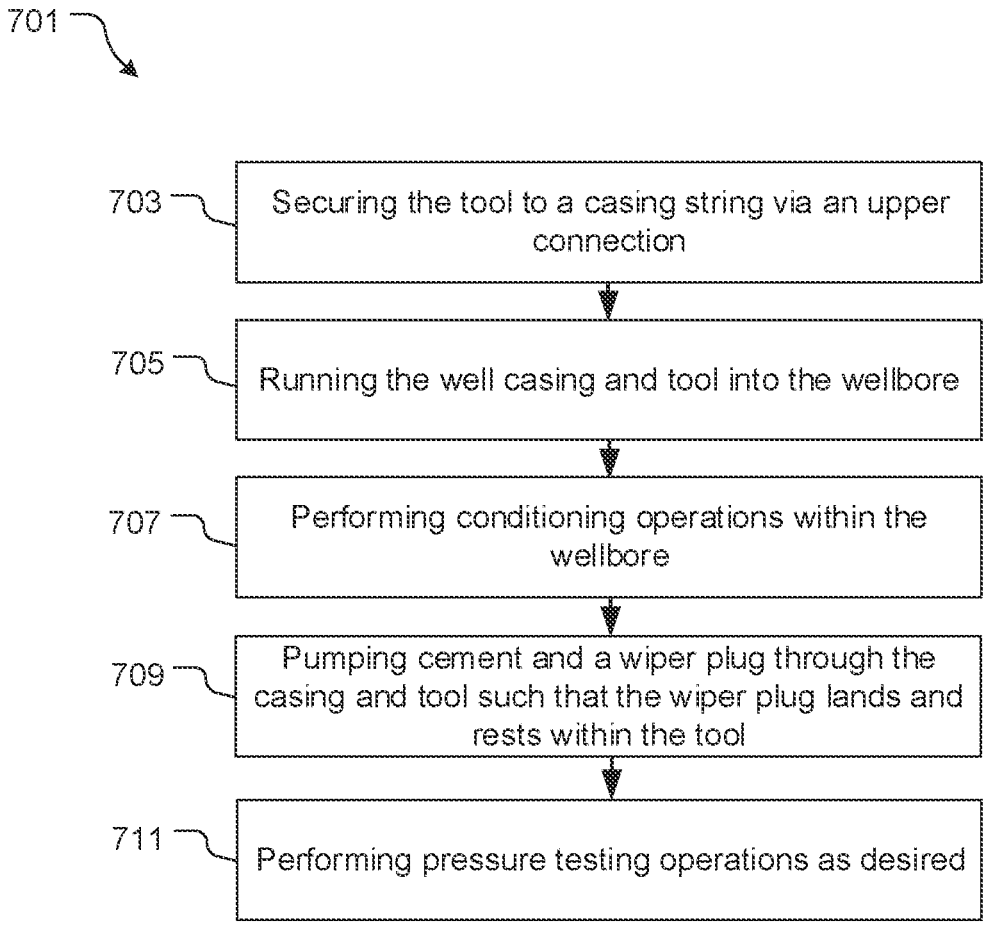
FIG. 7 is a flowchart of the method of use of the system of the present invention.

In FIG. 7, a flowchart 701 depicts a method associated with the present invention. During use, the tool 201 is secured to a lowermost casing string of the well casing, as shown with box 703. The well casing, along with the tool, is then run into the wellbore through conventional operations, as shown with box 705. The operator can then proceed to perform conditioning operations within the wellbore, wherein conditioning fluid is pumped through the tool, as shown with box 707. The operator can then pump cement and run one or more wiper plugs through the well casing, such that the one or more plugs engage with the landing seats of the tool, as shown with box 709. If desired, the user can perform pressure testing operations, wherein the tool is configured receive casing pressure testing without relying on shoe track cement integrity; and wherein the tool and plugs create a system configured to contain all required shoe track equipment as required by the operation, as shown with box 711.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

The invention claimed is:

1. A method of well construction, comprising:

providing a tool with a housing extending from a top end to a bottom end;

positioning a first valve within the housing, the first valve creating a lower seal within the housing to prevent formation fluid flow past the first valve and into a well casing from the bottom end of the housing during a well operation;

securing the tool to the well casing;

running the tool and the well casing into a wellbore; and performing one or more well operations, the one or more well operations do not establish cement integrity within the tool such that the first valve is not filled with cement, the one or more well operations including a casing pressure test;

wherein the first valve, without any established cement integrity, acts as an independent well barrier to independently prevent formation fluid flow into the well casing from the bottom end of the housing.

2. The method of claim 1, further comprising configuring the housing with a plug landing mechanism positioned therein, the plug landing mechanism configured to receive a plug, the plug landing mechanism being positioned above the first valve.

3. The method of claim 2, further comprising dropping the plug from a surface, wherein the plug is configured to land within the plug landing mechanism.

4. The method of claim 3, wherein the plug is configured to create an upper seal within the housing once landed within the plug landing mechanism.

5. The method of claim 4, wherein the plug does not have any intermittent engagement or stopping between the surface and the plug landing mechanism.

6. The method of claim 4, further comprising performing the casing pressure test after the plug is dropped from the surface and landed within the plug landing mechanism.

7. A tool for use in well construction, the tool comprising:

a housing extending from a top end to a bottom end;

a first valve secured within the housing, the first valve creating a lower seal within the housing to prevent formation fluid flow past the first valve and into a well casing from the bottom end of the housing during a well operation;

wherein the tool is configured to be secured to the well casing;

wherein the tool and the well casing are configured to be run into a wellbore;

wherein the tool is configured for use during one or more well operations, wherein the one or more well operations to not establish cement integrity within the tool such that the first valve is not filled with cement, the one or more well operations including a casing pressure test; and wherein the first valve, without any established cement integrity, acts as an independent well barrier to independently prevent formation fluid flow into the well casing from the bottom end of the housing.

8. The tool of claim 7, further comprising a plug landing mechanism positioned within the housing and configured to receive a plug, the plug landing mechanism positioned above the first valve and being a separate entity from the first valve.

9. The tool of claim 7, further comprising a plug landing mechanism positioned within the housing above the first valve, the plug landing mechanism configured to receive a plug.

10. The tool of claim 9, further comprising the plug, and wherein the plug is configured to be dropped from a surface and land within the plug landing mechanism.

11. The tool of claim 10, wherein the plug is configured to create an upper seal within the housing once landed within the plug landing mechanism.

12. The tool of claim 11, wherein the tool is configured such that the plug does not have any intermittent engagement or stopping between the surface and the plug landing mechanism.

13. The tool of claim 11, wherein the plug is configured to withstand the casing pressure test after the plug is dropped from the surface and landed within the plug landing mechanism.

14. A method of well construction, comprising:

providing a tool with a housing extending from a top end to a bottom end;

positioning a first valve within the housing, the first valve creating a lower seal within the housing to prevent formation fluid flow past the first valve and into a well casing from the bottom end of the housing during a well operation;

configuring the housing with a plug landing mechanism positioned therein, the plug landing mechanism configured to receive a plug, the plug landing mechanism being positioned above the first valve;

securing the tool to the well casing;

running the tool and the well casing into a wellbore;

dropping the plug from a surface, wherein the plug is configured to land within the plug landing mechanism and wherein the plug is configured to create an upper seal within the housing once landed within the plug landing mechanism; and performing one or more well operations, the one or more well operations do not establish cement integrity within the tool such that the first valve is not filled with cement, the one or more well operations including a casing pressure test, the casing pressure test being performed after the plug is dropped from the surface and landed within the plug landing mechanism;

wherein the first valve, without any established cement integrity, acts as an independent well barrier to independently prevent formation fluid flow into the well casing from the bottom end of the housing.

15. A tool for use in well construction, the tool comprising:

a housing extending from a top end to a bottom end;

a first valve secured within the housing, the first valve creating a lower seal within the housing to prevent formation fluid flow past the first valve and into a well casing from the bottom end of the housing during a well operation;

a plug landing mechanism positioned within the housing above the first valve;

a plug configured to be dropped from a surface and land within the plug landing mechanism;

wherein the tool is configured to be secured to the well casing;

wherein the tool and the well casing are configured to be run into a wellbore;

wherein the plug is configured to create an upper seal within the housing once landed within the plug landing mechanism;

wherein the plug is configured to withstand a casing pressure test after the plug is dropped from the surface and landed within the plug landing mechanism;

wherein the tool is configured for use during one or more well operations, the one or more well operations include the casing pressure test and do not establish cement integrity within the tool such that the first valve is not filled with cement; and wherein the first valve, without any established cement integrity, acts as an independent well barrier to independently prevent formation fluid flow into the well casing from the bottom end of the housing.

* * * * *